US007895900B2

(12) United States Patent
Keskiniva et al.

(10) Patent No.: US 7,895,900 B2
(45) Date of Patent: Mar. 1, 2011

(54) MEASURING DEVICE, ROCK BREAKING DEVICE AND METHOD OF MEASURING STRESS WAVE

(75) Inventors: Markku Keskiniva, Ylöjärvi (FI); Vesa Uitto, Tampere (FI); Heimo Ihalainen, Kangasala (FI); Jukka Lekkala, Tampere (FI)

(73) Assignee: Sandvik Mining and Construction Oy, Tampere (FI)

( * ) Notice: Subject to any disclaimer, the term of this patent is extended or adjusted under 35 U.S.C. 154(b) by 299 days.

(21) Appl. No.: 12/161,110

(22) PCT Filed: Jan. 16, 2007

(86) PCT No.: PCT/FI2007/050020

§ 371 (c)(1),
(2), (4) Date: Jul. 16, 2008

(87) PCT Pub. No.: WO2007/082997

PCT Pub. Date: Jul. 26, 2007

(65) Prior Publication Data

US 2010/0147084 A1 Jun. 17, 2010

(30) Foreign Application Priority Data

Jan. 17, 2006 (FI) ..... 20065029

(51) Int. Cl.
*G01B 7/16* (2006.01)

(52) U.S. Cl. ..... 73/781; 73/780; 73/784

(58) Field of Classification Search ..... 73/760–860
See application file for complete search history.

(56) References Cited

U.S. PATENT DOCUMENTS

| | | | | |
|---|---|---|---|---|
| 4,597,289 | A | 7/1986 | Obrecht | |
| 4,671,366 | A * | 6/1987 | Uitto et al. | 175/27 |
| 5,088,330 | A * | 2/1992 | Talmadge | 73/769 |
| 5,099,700 | A | 3/1992 | Morin et al. | |
| 5,458,207 | A | 10/1995 | Mattero | |
| 5,778,990 | A | 7/1998 | Niemi | |
| 6,356,077 | B1 | 3/2002 | Schaer et al. | |
| 6,640,205 | B2 | 10/2003 | Bongers-Ambrosius et al. | |
| 7,114,576 | B2 * | 10/2006 | Keskiniva | 173/2 |
| 7,717,190 | B2 * | 5/2010 | Keskiniva et al. | 173/1 |
| 2005/0109097 | A1 | 5/2005 | Bogath et al. | |

FOREIGN PATENT DOCUMENTS

| | | |
|---|---|---|
| GB | 2 160 320 | 12/1985 |
| JP | 61-026831 | 2/1986 |
| WO | 03/033873 | 4/2003 |
| WO | 2006/003259 | 1/2006 |

* cited by examiner

*Primary Examiner*—Max Noori
(74) *Attorney, Agent, or Firm*—Drinker Biddle & Reath LLP

(57) ABSTRACT

The invention relates to a method of measuring a stress wave and to a measuring device and a rock breaking device. A percussion device (7) gives impact pulses to a waveguide (21), where a compression stress wave and a reflected tensile stress wave are generated, which propagate in the waveguide. The compression stress wave causes an extension in the waveguide and the tensile stress wave a thinning, in which case properties of the waveguide may be determined by measuring geometric changes in the cross section of the waveguide. The measurement data are utilized in controlling the rock breaking device.

11 Claims, 9 Drawing Sheets

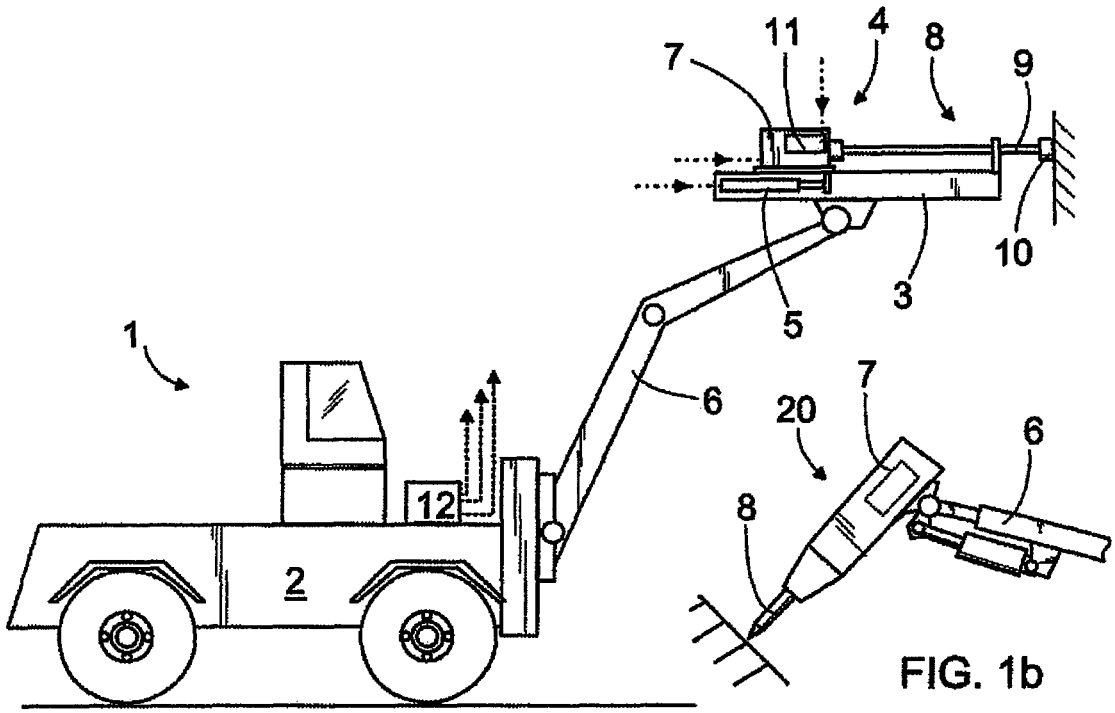
FIG. 1a
FIG. 1b
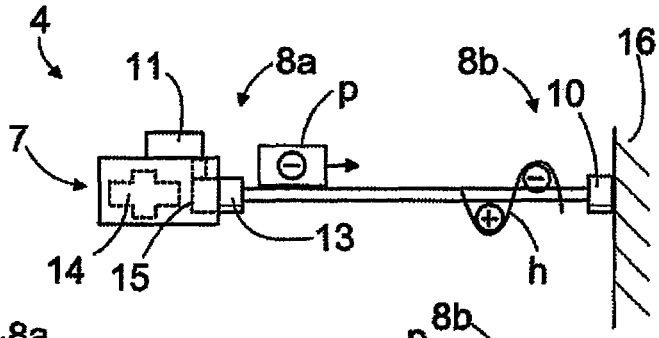
FIG. 2a
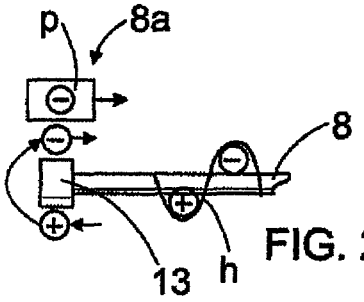
FIG. 2b
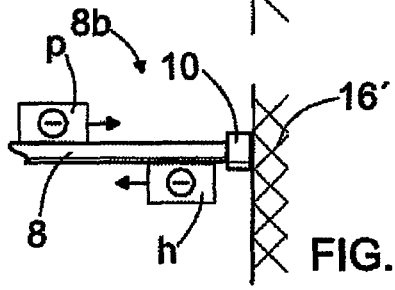
FIG. 2c
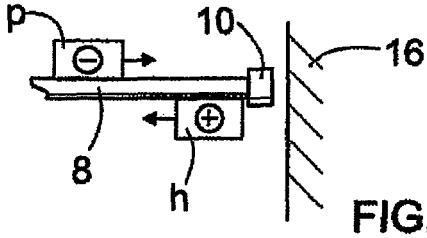
FIG. 2d

MEASURING DEVICE, ROCK BREAKING DEVICE AND METHOD OF MEASURING STRESS WAVE

CROSS REFERENCE TO RELATED APPLICATIONS:

This application is the National Stage of International Application No. PCT/FI2007/050020, filed Jan. 16, 2007, and claims benefit of Finnish Application No. 20065029, filed Jan. 17, 2006.

BACKGROUND OF THE INVENTION

The invention relates to a method of measuring a stress wave used in breaking rock, the method comprising measuring a stress wave which propagates in a waveguide.

The invention further relates to a measuring device for measuring a stress wave, the device comprising: at least one measuring member; and at least one control unit for processing measurement results.

The invention further relates to a rock breaking device which comprises: a frame; a tool; a device for generating stress waves in the tool; measuring means for measuring the stress wave travelling in the tool; at least one control unit for controlling the rock breaking device on the basis of the measured stress wave.

Rock breaking may be performed by drilling holes in a rock by a percussion rock drilling machine. Alternatively, rock may be broken by a breaking hammer. In this context, the term "rock" is to be understood broadly to also cover a boulder, rock material, crust and other relatively hard material. The rock drilling machine and breaking hammer comprise a percussion device, which gives impact pulses to the tool either directly or through a shank. In other words, the percussion device is used to generate a compression stress wave in the tool, where the wave propagates to the outmost end of the tool. When the compression stress wave reaches the tool's outmost end, the tool penetrates into the rock due to the influence of the wave. Some of the energy of the compression stress wave generated by the percussion device is reflected back as a reflected wave, which propagates in the opposite direction in the tool, i.e. towards the percussion device. Depending on the situation, the reflected wave may comprise only a compression stress wave or a tensile stress wave. However, the reflected wave typically comprises both the tension and the compression stress component. The stress wave travelling in the tool may be measured and the measurement result employed in controlling a rock breaking device as described in U.S. Pat. No. 4,671,366, for example. Typically, resistance strain gauges are used in measuring the stress wave but the attachment of the gauges poses a problem. It is difficult to glue strain gauges to the tool. U.S. Pat. Nos. 6,356,077 and 6,640,205 further describe arranging a coil around the tool for measuring magnetostrictive or magnetoelastic changes caused by stress waves in the tool. A problem associated with these inductive methods is that the consistence and magnetic history of the tool's material affect the measurement accuracy.

BRIEF DESCRIPTION OF THE INVENTION

An object of the invention is to provide a new and improved arrangement for measuring a stress wave from a waveguide.

The method according to the invention is characterized by determining a geometric change in the cross section of the waveguide as the stress wave passes a measuring point; and determining properties of the stress wave from the change in the cross section.

The measuring device according to the invention is characterized in that the measuring device comprises measuring members for detecting a geometric change in the cross section of the waveguide due to the influence of the stress wave; and the control unit is arranged to determine properties of the measured stress wave from the change in the cross section of the waveguide.

The rock breaking device according to the invention is characterized in that the rock breaking device comprises means for detecting a geometric change in the cross section of the tool due to the influence of the stress wave; and at least one control unit is arranged to determine properties of the stress wave on the basis of the change in the cross section of the tool for controlling the rock breaking device.

The invention is based on determining the influence of the stress wave travelling in the waveguide in the geometric cross section of the waveguide and on determining properties of the stress wave on the basis of this. A compression stress wave tries to compress the waveguide in the longitudinal direction, in which case the cross section of the waveguide tends to increase at the compression stress wave. Correspondingly, the tensile stress wave tries to stretch the waveguide in the longitudinal direction, in which case the geometric cross-sectional area of the waveguide tends to decrease at the tensile stress wave. The magnitude of the change in the cross section has been found to correlate directly with the strength of the stress wave.

An advantage of the invention is that it is easier to control the measuring of stress waves than in the case of magnetostrictive and magnetoelastic measuring methods.

The basic idea of an embodiment according to the invention is to arrange one or more electrically conductive measuring electrodes near the waveguide or around it, the electrode forming a capacitor together with the waveguide and an insulation gap. The measuring device is arranged to determine capacitance of the capacitor thus formed. The capacitance is substantially influenced only by the size of the insulation gap. The size of the insulation gap is, on the other hand, influenced by the expansion or thinning of the waveguide, which are caused by stress waves travelling in the waveguide. The measuring device may measure a capacitive change between the waveguide and the electrode, or alternatively, it may be arranged to measure capacitance between two measuring electrodes, which both form a capacitor with the waveguide.

The basic idea of an embodiment of the invention is that the measuring electrode used for capacitive measurement is an electrically conductive ring, which is arranged around the waveguide.

The basic idea of an embodiment of the invention is that the measurement of stress wave is contact-free, in which case the waveguide may turn about its axis and move in the axial direction without the measuring members preventing this. This is advantageous in rock drilling, in particular, because the tool is typically rotated by a rotating device during drilling.

The basic idea of an embodiment of the invention is that at least two measuring electrodes used in capacitive measurement are arranged one after the other in the longitudinal direction of the waveguide. The successive measuring electrodes are insulated from each other. In that case, measuring signals may be supplied from the successive measuring electrodes to at least one control unit along wires or the like, in which case there is no mechanical contact between the measuring device and the waveguide but measurement may be contact-free.

The basic idea of an embodiment of the invention is that the measuring electrode used in capacitive measurement is mounted in the waveguide by bearings so that it maintains its position with respect to the waveguide regardless of any transverse shift of the waveguide. In that case, a transverse shift of the waveguide does not substantially affect the measurement result at all.

The basic idea of an embodiment according to the invention is that two or more measuring electrodes based on capacitive measurement are used at least at one measuring point, the measuring electrodes being arranged at the same point in the longitudinal direction of the waveguide but on the opposite sides of the waveguide with respect to each other. The stress wave may be measured by determining capacitance between the electrode parts on the opposite sides of the waveguide and the waveguide. In that case, it is not necessary to connect the measuring electrodes mechanically to the waveguide but measurement may be contact-free. On the other hand, measurement results received from the measuring electrodes may be processed in the control unit of the measuring device by, for example, filtering out the trans-verse shift of the waveguide. In that case, transverse movements between the waveguide and the measuring electrodes have no effect on the measurement results but the stress wave is determined only on the basis of a change in the geometric cross section of the waveguide.

The basic idea of an embodiment according to the invention is that the measuring electrode is arranged at the largest outer dimension of the waveguide, in which case measurement accuracy can be better. In a rock drilling machine, the measuring electrode may be arranged around the shank, for example, because the diameter of the shank is typically larger than that of a drill rod.

The basic idea of an embodiment of the invention is that the control unit is arranged to adjust control parameters of a rock breaking device on the basis of the measured stress wave. The control unit may comprise one or more adjustment strategies which may be aimed at, for example, achieving the maximum penetration rate of the tool, improving the bore hole quality in drilling, achieving a longer duration of the tool and equipment or improving the efficiency of the rock breaking device. The control parameters may include percussion frequency, percussion energy and feed force. Furthermore, feed rate, rotation rate and flushing may be used as control parameters in rock drilling.

The basic idea of an embodiment of the invention is that the measuring device comprises at least one memory element for storing measurement results. In that case, measurement results may be stored and utilized later, for example, to find out the rock type of the work site and in designing the work site and the method to be used or in monitoring the condition. Measurement results may be processed in a separate computing unit.

An embodiment of the invention is based on the idea that the measuring device comprises at least one data transfer member for transmitting measurement results from the measuring device to the control unit of the rock breaking device or to another device. In that case, measurement results may be employed in controlling a drilling process or a breaking process.

An embodiment of the invention is based on the idea of measuring a change in the cross section of the waveguide by an electromechanic film (EMFi), which reacts to compression directed to it as the cross section the waveguide increases and decreases.

An embodiment of the invention is based on the idea of measuring a change in the cross section of the waveguide by a laser beam.

An embodiment of the invention is based on the idea of measuring a stress wave on the basis of a change in the volume of the waveguide.

BRIEF DESCRIPTION OF THE FIGURES

Some embodiments of the invention will be described in greater detail in the accompanying drawings, in which FIG. 1*a* is a schematic side view of a rock drilling rig, FIG. 1*b* is a schematic side view of a breaking hammer, FIG. 2*a* is a schematic side view of a rock drilling machine and a tool connected thereto in a drilling situation, FIG. 2*b* schematically illustrates a first end of the tool, i.e. the end towards a percussion device, and travel of a reflected stress wave, FIGS. 2*c* and 2*d* schematically illustrate special situations in drilling and reflection of the stress wave back from the outmost end of the tool, i.e. from the second end, FIG. 3 schematically illustrates a cross section of a waveguide and a principle of measuring stress waves according to the invention, FIG. 4*a* schematically illustrates capacitive measurement of stress waves by one electrode arranged around the waveguide seen from the longitudinal direction of the tool, FIG. 4*b* schematically illustrates division of a measurement electrode based on capacitive measurement into several electrode parts around the waveguide seen from the longitudinal direction of the tool.

For the sake of clarity, the figures illustrate some embodiments of the invention in a simplified manner. Like reference numbers refer to like parts in the figures.

DETAILED DESCRIPTION OF SOME EMBODIMENTS OF THE INVENTION

Figure 3:
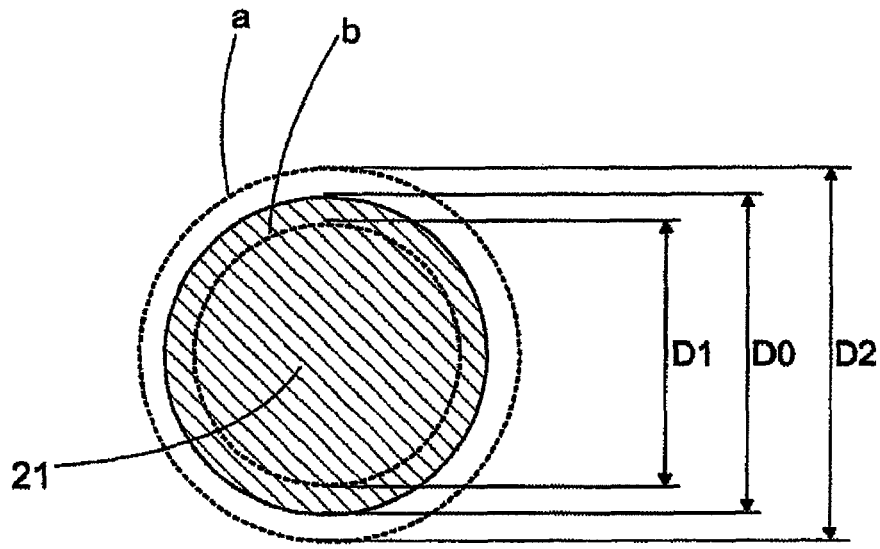

FIG. 1 illustrates a rock drilling rig 1, which comprises a carrier 2 and at least one feed beam 3, on which a rock drilling machine 4 is arranged movably. By means of a feed device 5, the rock drilling machine 4 may be pushed towards the rock to be drilled and correspondingly pulled away from it. The feed device 5 may comprise, for example, one or more hydraulic cylinders, which may be arranged to move the rock drilling machine 4 by suitable power transmission means. Typically, the feed beam 3 is arranged in a boom 6 which may be moved with respect to the carrier 2. The rock drilling machine 4 comprises a percussion device 7 for giving impact pulses to a tool 8 connected to the rock drilling machine 4. The tool 8 may comprise one or more drill rods and a drill bit 10. Furthermore, the drill 4 may comprise a rotation device 11 for rotating the tool 8 about its longitudinal axis. During drilling, the percussion device 7 gives impact pulses to the tool 8, which may simultaneously be rotated by the rotating device 11. Furthermore, the rock drilling machine 4 may be pushed towards the rock during drilling so that the drill bit 10 can break the rock. Rock drilling may be controlled by one or more control units 12. The control unit 12 may comprise a computer or the like. The control unit 12 may give control commands to actuators controlling the operation of the rock drilling rig 4 and the feed device 5, such as valves controlling pressure medium. The percussion device 7, rotation device 11 and feed device 5 of the rock drilling machine 4 may be pressure medium operated actuators or they may be electric actuators.

FIG. 2*a* illustrates a rock drilling machine 4 where a tool 8 is connected to its shank 13. The percussion device 7 included in the rock drilling machine 4 may comprise a percussion element 14, such as a percussion piston, which is arranged to be moved to and fro and to impact a percussion surface 15 in the shank 13 and generate an impact pulse, which propagates at a rate depending on the material as a compression stress wave through the shank 13 and the tool 8 to the drill bit 10. One special case of rock drilling is illustrated in FIG. 2*c*, where the drill bit 10 cannot penetrate into the rock 16 due to the influence of the compression stress wave p. The reason for this may be, for example, a very hard rock material 16'. In that case, the original stress wave p is reflected back as a compression stress wave h from the drill bit 10 towards the percussion device 7. Another special case is illustrated in FIG. 2*d*, where the drill bit 10 may move forward without the resisting force. For example, when drilling is performed on a cave in rock, the penetration resistance is small. In that case, the original compression stress wave p is reflected as a tension reflected wave from the drill bit 10 towards the percussion device 7. In practical drilling, which is illustrated in FIG. 2*a*, the drill bit 10 is subjected to resistance but can still move forward due to the influence of the compression stress wave p. The forward movement of the drill bit 10 is resisted by a force whose magnitude depends on how much the drill bit 10 has penetrated into the rock 16; the deeper the drill bit 10 penetrates, the greater the resisting force and vice versa. Thus in practical drilling, a reflected wave h is reflected from the drill bit 10, the wave comprising both the tension and compression reflection components. In the figures, the tensile stress is denoted by (+) sign and the compression stress by (−) sign. The tension reflection component (+) is always first in a reflected wave h and the compression stress component (−) follows it. The reason for this is that at the initial stage of the influence of the primary compression stress wave p, the penetration and penetration resistance of the drill bit 10 are small, which produces a tension reflection component (+). The initial situation thus resembles the special situation described above where the drill bit 10 may move forward without a significant resisting force. At the final stage of the effect of the primary compression stress wave p, on the other hand, the drill bit 10 has already penetrated deeper into the rock 16, in which case the penetration resistance is greater and the original compression stress wave p can no longer substantially push the drill bit 10 deeper into the rock 16. This situation resembles the second special case described above where the drill bit 10 is prevented from moving forward into the rock 16. This produces a reflected compression stress wave (−), which follows immediately the tensile stress wave (+) reflected first from the drill bit 10.

In rock drilling, the stress wave can be measured from the shank, drill rod or both, which thus function as the waveguide.

In the breaking hammer 20 illustrated in FIG. 1*b*, a chisel or a chisel holder may function as the waveguide. Also in the breaking hammer 20, the percussion device generates a stress wave in the tool that propagates from the first end of the tool, i.e. the end towards the percussion device, to the second end of the tool and then back to the tool's first end.

FIG. 3 illustrates the measuring principle according to the invention. A change occurs in the geometric cross section of the waveguide 21 as a stress wave travels therein. The invention is based on the idea of measuring this geometric change in the cross section and on using the measurement result as a basis for determining properties of the stress wave, such as wave form, amplitude, wave length, frequency, etc. When the compression stress wave travels in the waveguide 21, its cross section tends to compress at the stress wave, in which case its cross section increases. Correspondingly, at the tensile stress wave, the cross section decreases. In other words, an expansion or a thinning is formed in the waveguide depending on whether the stress wave is a compression stress wave or a tensile stress wave. In FIG. 3, broken line a illustrates, in a strongly simplified manner, an increase in the cross section due to the influence of the compression stress wave and broken line b a decrease in the cross section due to the influence of the tensile stress wave. The measurement may be based on a change in the outer dimension of the waveguide 21, a change in the inner dimension of a tubular waveguide, a change in the cross-sectional area or on a change in the volume of the waveguide.

Figure 4A:
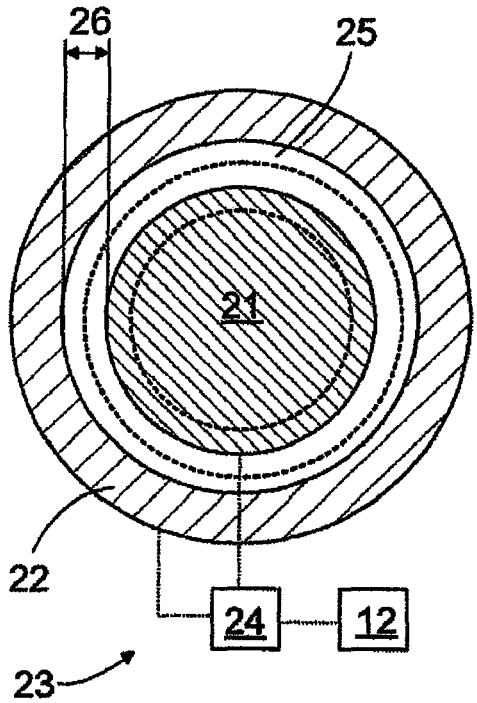

FIG. 4*a* illustrates the principle of capacitive stress wave measurement. An annular electrically conductive measuring electrode 22, such as a metal ring connected to the control unit 24 included in the measuring device 23, is arranged around the waveguide 21. Between the outer dimension of the waveguide 21 and the measuring electrode, there may be an insulation layer 25, which may be air, lubricating oil, flushing fluid or the like. When the stress wave travels in the waveguide, a change occurs in its outer dimension, which affects the thickness of the insulation layer 25. The capacity of a capacitor formed by the waveguide 21, insulation layer 25 and measuring electrode 22 is measured by a measuring device 23. In measurement, the permittivity of the insulation material does not substantially change. The area of the outer surface of the waveguide changes as the cross section changes and thus also affects capacitance. However, the capacitance is mainly influenced by the size of an insulation gap 26. The size of the insulation gap 26 may thus be determined by measuring voltage, the size of the gap being dependent on the expansion or thinning caused by the stress wave. Furthermore, the capacitor formed by the waveguide 21, insulation gap 26 and measuring electrode 22 may be connected to a resonance circuit or the like, in which case frequency changes in the circuit are considered in the measurement. Other ways of measuring the capacitance may also be applied. The information measured from the stress waves may be transmitted from the control unit 24 of the measuring device to the control unit 12 of the breaking device.

Furthermore, the insulation layer 25 may consist of several different portions. For example, the measuring electrode 22 may be provided with a plastic casing or frame where the electrically conductive parts of the electrode 22 are arranged. In that case, the insulation layer 25 between the outer dimension of the waveguide 21 and the electrode 22 may consist of plastic material and air. Also when the electrode 22, waveguide 21 or both are coated with a coating agent made of insulation material, the insulation layer 25 comprises several different portions. The influence of different insulation portions may be taken into account when the measurement results are processed. Furthermore, when the insulation layer 25 comprises several superimposed portions, one or more portions may be compressible so as to enable changes in the cross section of the waveguide 21 and measurement of the changes.

Figure 4B:
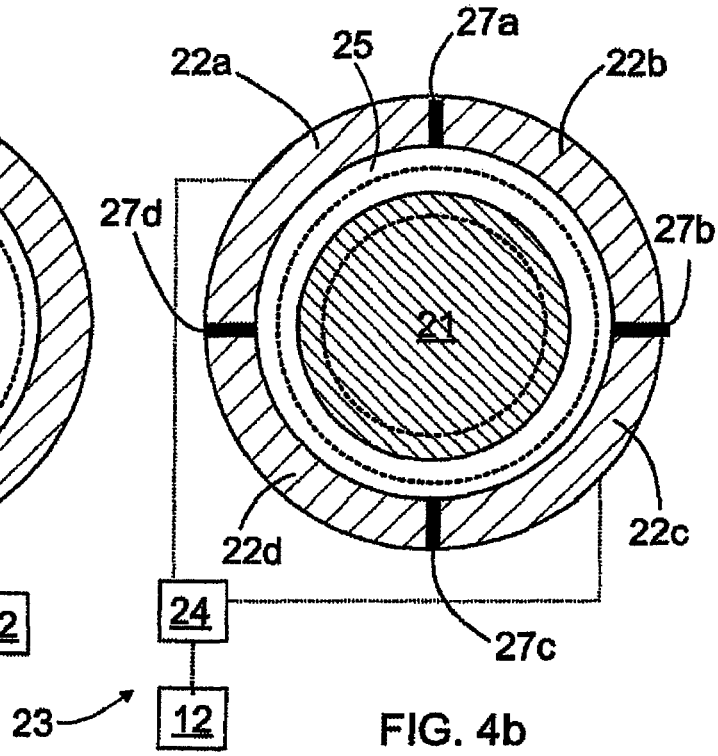

FIG. 4*b* further illustrates that the measuring electrode 22 may be divided into several parts 22*a* to 22*d*, which have the shape of the torus sector and between which there are insulations 27*a* to 27*d*. The number of the parts 27 of the measuring electrode may be four as shown in the figure, but on the other hand, there may be two or more of them. The measuring device 23 may be used for measuring the capacitors formed by the electrode parts 22*a* and 22*c*; 22*b* and 22*d* on the opposite sides, in which case measurement may be contact-free. Furthermore, this arrangement enables taking into account any transverse shift of the waveguide 21 with respect to the parts 22 of the measuring electrode. Measuring information may be transmitted from each part 22 of the measuring electrode to the control unit 24, where measurement results may be filtered so as to eliminate an error caused by the transverse shift of the waveguide. The waveguide 21 may move in the cross direction as a result of a damage to the bearings, for instance.

Figure 5:
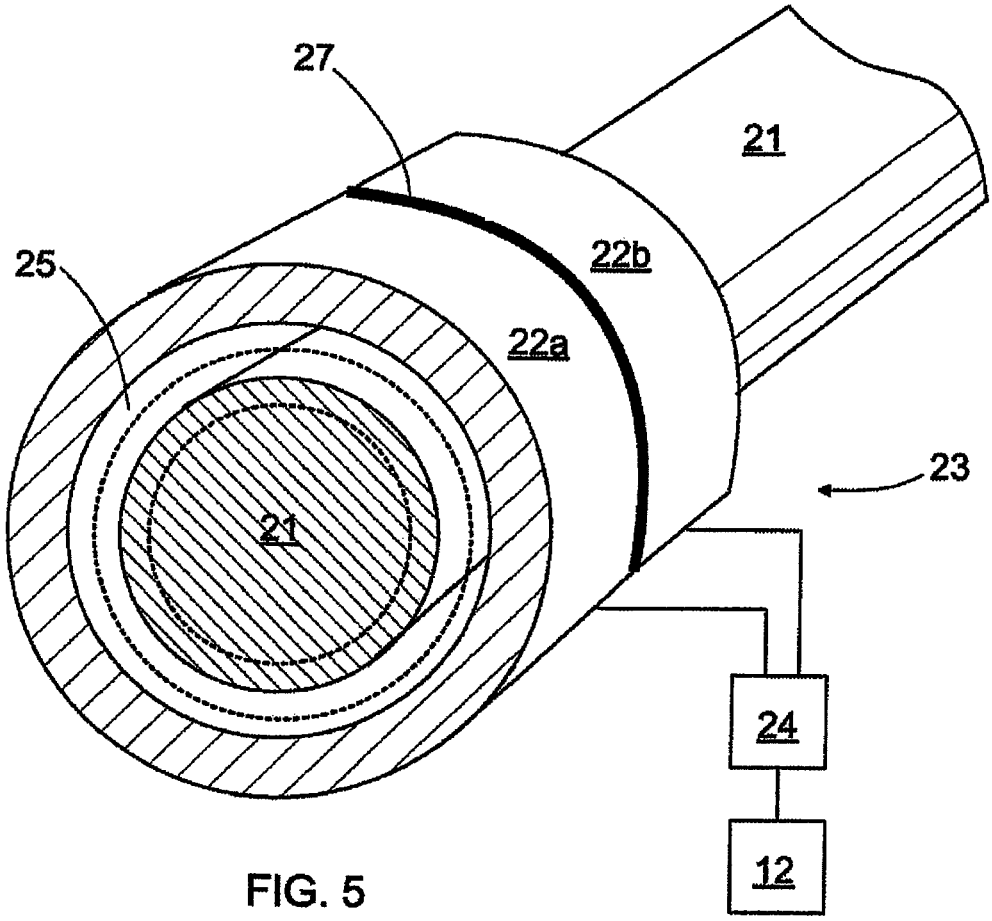
FIG. 5 is a schematic perspective view of capacitive measurement of stress waves by several successive electrodes in the axial direction, FIG. 6 schematically illustrates capacitive measurement of stress waves by one or more electrodes arranged inside a tubular waveguide, seen from the longitudinal direction of the tool.

FIG. 5 illustrates a solution where two measuring electrodes 22*a*, 22*b* are arranged one after the other in the axial direction. Between the measuring electrodes 22, there is an air gap or another insulation layer 27. If necessary, three or more measuring electrodes may be arranged one after the other in the axial direction. In this embodiment, capacitance is measured by a measuring device 23 between successive measuring electrodes 22*a*, 22*b* and the waveguide 21. The measurement may be contact-free, i.e. there is no mechanical contact between the measuring electrodes and the waveguide. Furthermore, one or more of the measuring electrodes 22 may consist of two or more electrode parts as shown, for example, in FIG. 4*b*, in which case the measurement error caused by the eccentricity of the waveguide 21 may be eliminated by filtering.

Figure 6:
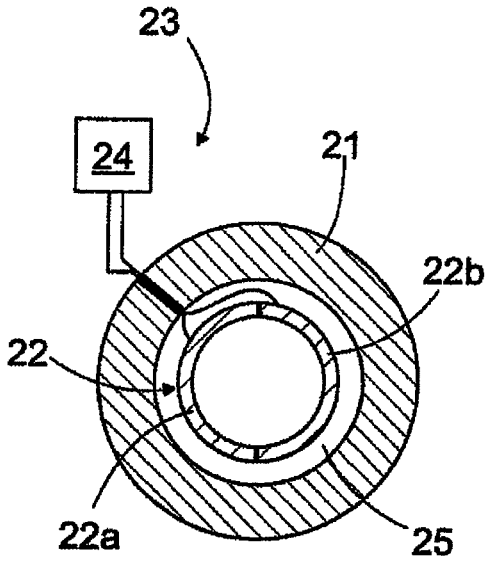

FIG. 6 illustrates an embodiment where the measuring electrode 22 is arranged inside a tubular waveguide 21. In that case, the waveguide 21 has an annular cross section, comprising an inner diameter and an outer diameter. It should be mentioned that, for example, the drill rod and shank used in rock drilling typically have an annular cross section for supplying flushing fluid. The measuring electrode 22 may be supported by suitable support members inside the waveguide 21. The measuring electrode 22 may comprise several electrode parts 22*a*, 22*b*, in which case capacitance may be measured between the electrode parts. Furthermore, since it comprises several electrode parts, it needs not be centred accurately inside the waveguide, but any deviation from the centred axis of the waveguide 21 may be taken into account in the filtering of the measurement results carried out in the control unit 24.

Figure 7:
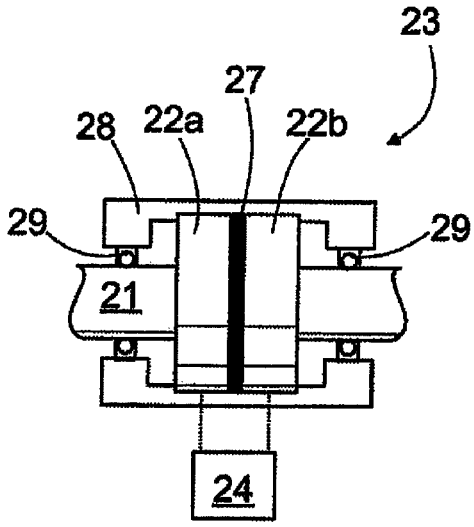
FIG. 7 is a schematic side view of an arrangement where measuring electrodes are mounted by bearings in the waveguide to be measured, FIG. 8 schematically illustrates a principle of stress wave measurement based on laser interferometry, seen from the longitudinal direction of the tool, FIG. 9 schematically illustrates measurement of stress waves based on a medium around the waveguide, such as an EMFi film, seen from the longitudinal direction of the tool, FIG. 10 schematically illustrates measurement of stress waves based on a change in the volume of the fluid space around the tool, seen from the longitudinal direction of the tool, FIGS. 11 to 13 schematically illustrate some curves defined on the basis of capacitive measurement in a situation where rock is drilled by under feed, FIGS. 14 to 16 schematically illustrate some curves defined on the basis of capacitive measurement in a situation where the rock to be drilled is a soft rock, and FIGS. 17 to 20 schematically illustrate some curves relating to compensating for eccentricity between capacitive measuring electrodes and the waveguide.

FIG. 7 illustrates a strongly simplified embodiment where the measuring electrodes 22*a*, 22*b* are mounted in the waveguide 21 by bearings so that the waveguide 21 may move in the axial direction with respect to the measuring electrodes 22 and turn about its longitudinal axis. The measuring electrodes 22, instead, are arranged to move with the waveguide 21 if this moves in the cross direction. In that case, the measuring electrodes 22 remain coaxial with the waveguide 21 even though the waveguide 21 would for some reason move from its original position. The measuring electrodes 22 may be arranged in a measuring frame 28, which may be supported by one or more bearings 29 against the outer surface of the waveguide 21. Other ways of mounting the measuring electrodes 22 in the outer surface of the waveguide 21 by bearings may naturally also be applied.

Figure 8:
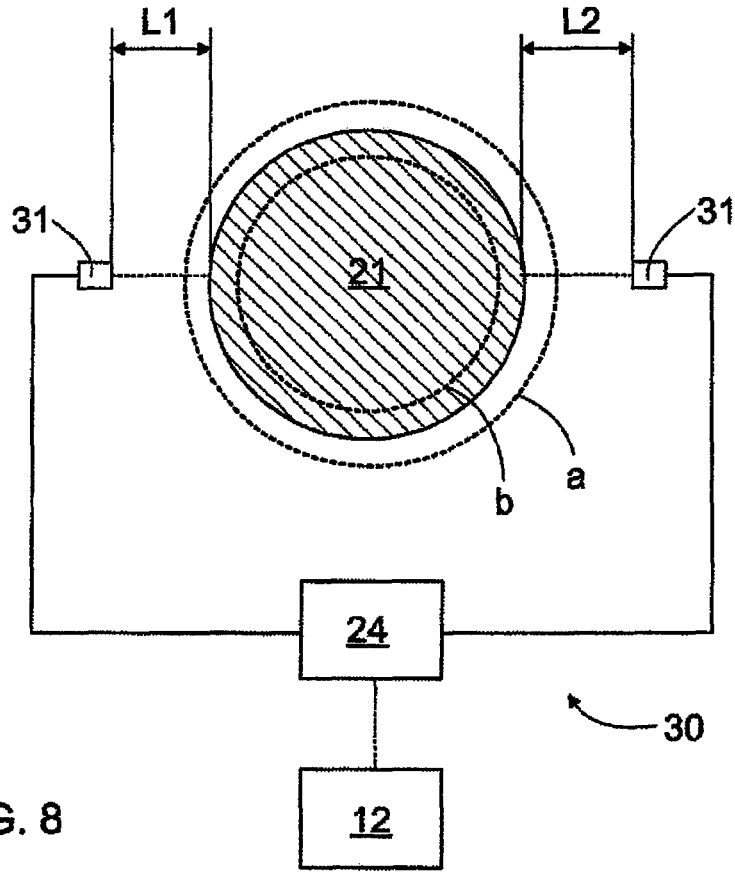

FIG. 8 illustrates an embodiment where changes occurring in the geometric cross section of the waveguide are measured by a laser interferometer 30. The opposite sides of the waveguide 21 may be provided with laser beam transceivers 31 for measuring distances L1, L2 to the outer surface of the waveguide 21. An expansion caused by the compression stress wave is noticed as an increase in the distances L1 and L2 and, correspondingly, the thinning caused by the tensile stress wave is noticed as a decrease in the distances L1 and L2. The control unit 24 of the measuring device may analyze the measuring results and determine properties of the stress wave from them. Furthermore, if one of the measured distances decreases and the other increases, the control unit 24 of the measuring device may interpret this as a transverse shift of the waveguide and not as a measure change caused by the stress wave. Instead of the laser interferometer, it is feasible to use another optical distance measuring device which is capable of detecting a shift caused by the stress wave in the cross direction of the waveguide.

Figure 9:
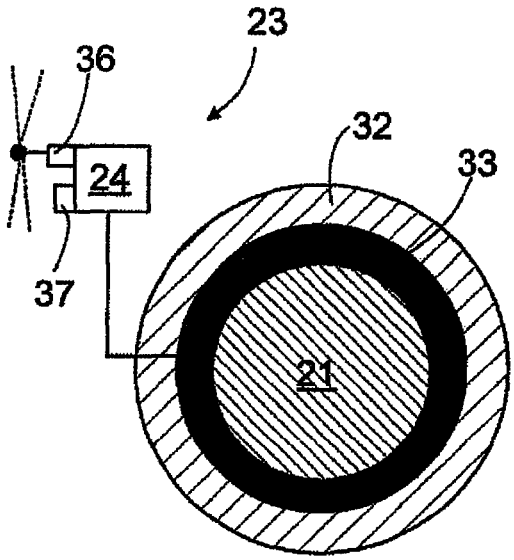

FIG. 9 illustrates an embodiment where a medium film 33 is arranged in a gap between the waveguide 21 and a reference surface 32, such as the drill frame. The medium film reacts to a change in the compression pressure caused by a measure change of the cross section of the waveguide. Due to the influence of the compression stress wave, the outer dimension of the waveguide 21 increases, in which case a larger pressure is directed at the medium film 33 arranged in the gap as it is between the waveguide 21 and the reference surface 32. Correspondingly, the pressure directed at the medium film 33 decreases when the tensile stress wave reaches the measuring point. The medium film 33 reacting to the compression pressure may be, for example, an electromechanical film (EMFi) or the like. The electromechanical film may be a thin constantly charged plastic film whose both sides may be coated with electrically conductive layers. The compression directed at the film can be detected as a voltage signal generated by the film. The control unit 24 of the measuring device 23 may analyse the voltage signal and determine properties of the stress wave from it. FIG. 9 further illustrates a data communication connection 36 and a memory element 37, which may be arranged in connection with the measuring device 23 for processing measurement data. The measurement data may be transmitted from the measuring device 23 in a wireless or wired manner by means of the data communication connection 36 to the control unit 12 of the rock breaking device or elsewhere. Furthermore, measurement data may be stored in the memory element 37 for further processing. The measurement data stored in the memory element 37 may be utilized in condition monitoring, in collecting data on the rock type and in designing a mine or the like.

Figure 10:
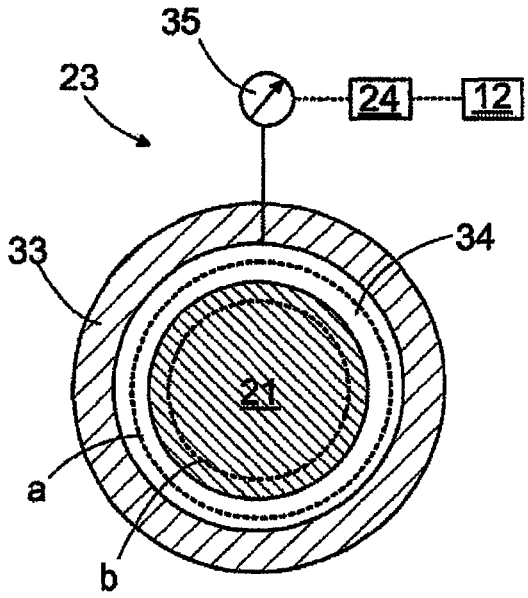

FIG. 10 illustrates a further embodiment where a pressure fluid space 34 is formed around the waveguide 21. The pressure fluid acting therein is measured by a pressure sensor 35. The stress wave causes a measure change in the cross section of the waveguide 21, in which case the volume of the waveguide 21 also changes in the axial portion concerned. The change in the volume of the waveguide 21 also causes a change in the volume of the pressure fluid space 34, which can be detected as pressure pulses in pressure measurement. The measurement results may be transmitted to the control unit 24 of the measuring device 23, which may analyze pressure pulses and determine stress wave properties from them.

One or more control strategies may be set in the control unit 12 of the rock drilling rig or breaking hammer for automatically adjusting the operation of the device on the basis of the measured stress wave. Adjustment may also be performed manually, in which case the operator receives information from the control unit 12 on the control data calculated on the basis of the stress wave and may manually adjust the parameters. Both the control unit 12 of the rock breaking device and the control unit 24 of the measuring device 23 may comprise one or more computers, whose processor may execute a computer program product. The computer program product that executes the measurement and adjustment according to the invention may be stored in the memory of the control unit 12, 24, or the computer program product may be loaded into the computer from a memory element, such as a CD-ROM. Furthermore, the computer program product may be loaded from another computer over a data network, for example, into a device belonging to the control system.

The control unit 24 of the measuring device 23 may be integrated into the primary machine, for example into the control unit 12 of the rock drilling rig or excavating machine, or it may be a separate unit. The control unit 24 may control the internal operation of the measuring device 23, such as filtering measuring signals, computing, storing, display and transmission to another unit or another similar process. In some cases, the control unit 24 may also control an external function or device.

Electrodes included in the measuring device 23, sensors or other measuring members may also be connected to transmit measuring signals directly to the control unit 12 of the breaking device.

In the following, three examples are described where rock is drilled by a percussion rock drilling rig and a stress wave travelling in a tool is measured by a capacitive measuring device.

EXAMPLE 1

Figure 11:
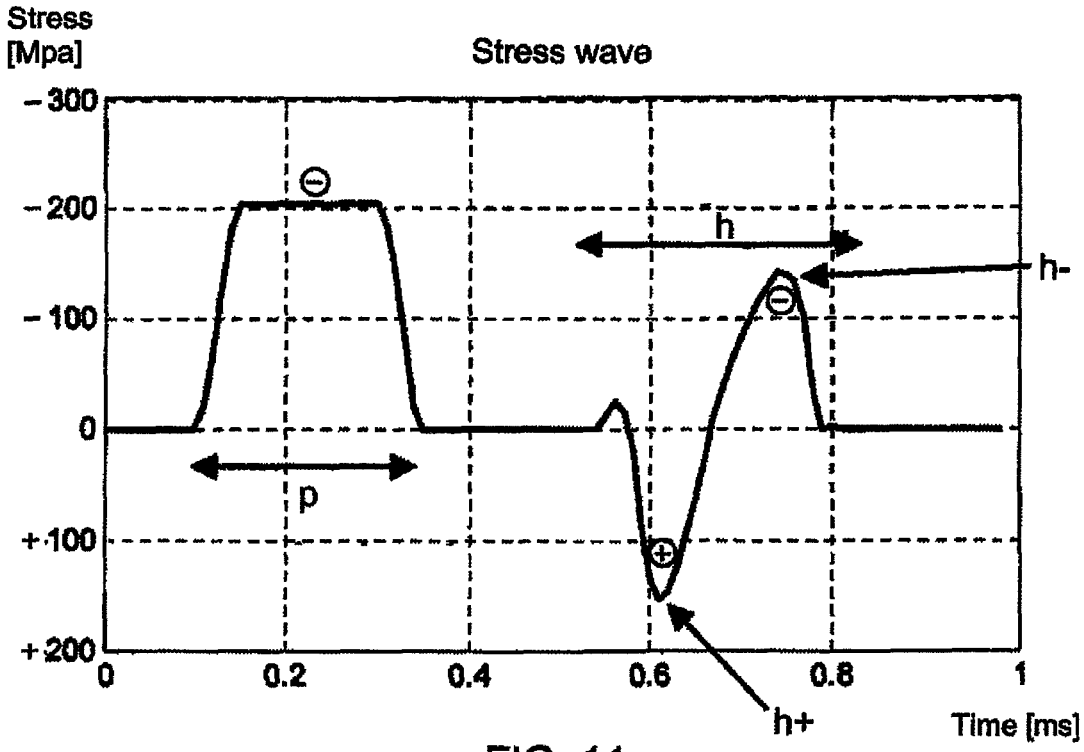

FIG. 11 illustrates curves of a primary stress wave p and reflected stress wave h as a function of time. In this case, a percussion device included in the rock drilling rig has given an impact pulse to the tool, which has generated a primary compression stress wave in the tool, the wave propagating in the tool towards its outmost end. If drilling is performed at under feed, there may be a gap between the tool and the rock. In that case, the tool experiences no penetration resistance at the beginning due to the gap, which causes a large reflected tensile stress wave h+, which propagates towards the percussion device. After the gap between the tool and the rock has closed, the penetration resistance is again great, which causes a large reflected compression stress wave h−, which propagates towards the percussion device behind the reflected tensile stress wave h+. When a reflected wave h having this form is detected, the control unit may interpret that drilling is performed at under feed. In that case, the control action may be: increase the feed.

Figure 12:
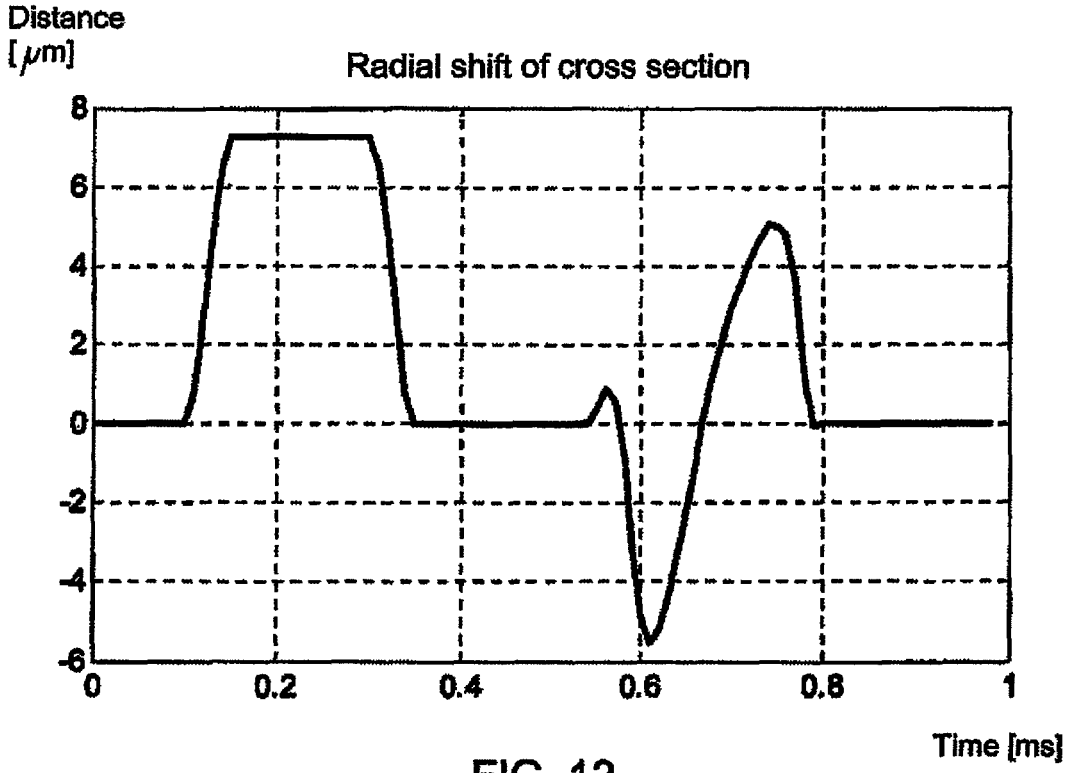
Figure 13:
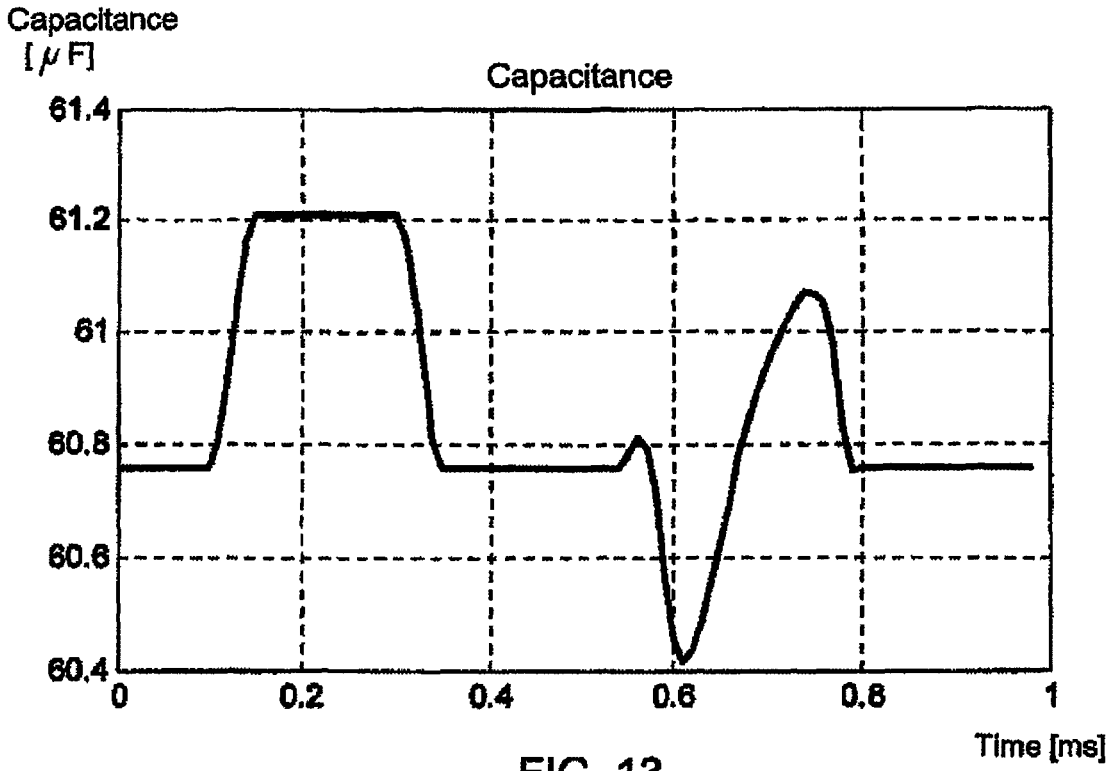

FIG. 13 illustrates measurement results of a capacitive measuring device and FIG. 12 illustrates a radial shift in the cross section of the waveguide determined from the measurement results. As can be seen from FIGS. 11 to 13, the change in the capacitance and the radial shift in the waveguide substantially correspond to the form of the stress wave.

The radial shift of the cross section may be calculated by the following formula:

$$u_R = \upsilon \frac{\sigma}{E} r_0$$

where $\upsilon$ is the Poisson constant of the material, E the elasticity modulus and $r_0$ is the outer radius of a non-deformed cross section.

Furthermore, capacitance may be calculated for an annular electrode using the following formula:

$$C = \frac{2\pi\varepsilon_0\varepsilon L}{\cosh^{-1}\left(\frac{|d^2 - r^2 - R^2|}{2rR}\right)} = \frac{2\pi\varepsilon_0\varepsilon L}{\cosh^{-1}\left(\frac{|d^2 - (r_0 + u_R)^2 - R^2|}{2(r_0 + u_R)R}\right)}$$

where $\epsilon_0$ is the permittivity of a vacuum, $\epsilon$ is the relative permittivity of an insulation, d is the distance (eccentricity) between the centre points of the annular electrode and the tool, r is the outer radius of the tool (including deformation $r=r_0+u_R$) and R is the inner radius of the electrode.

EXAMPLE 2

Figure 14:
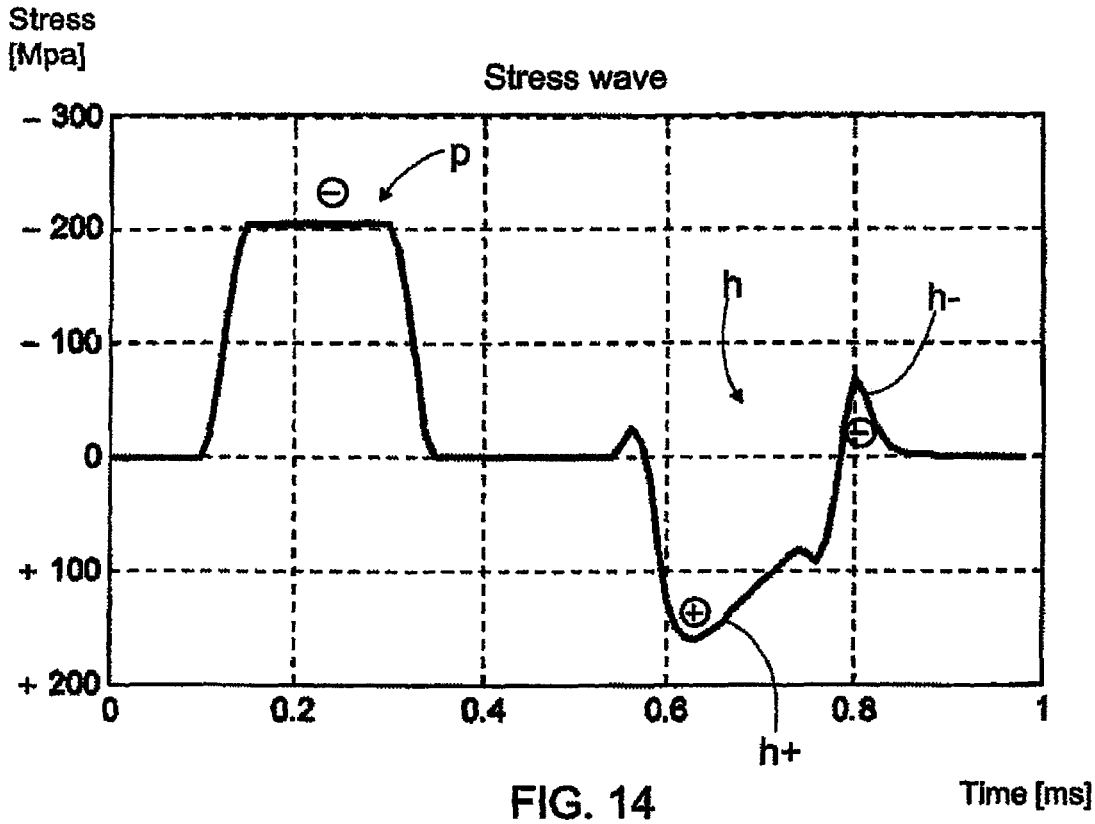

FIG. 14 illustrates curves of a primary stress wave p and reflected stress wave h as a function of time. In this case, the percussion device included in a rock drilling rig has given an impact pulse to the tool, which has generated a primary compression stress wave p in the tool which propagates in the tool towards its outmost end. If a very soft rock is drilled, the penetration resistance is small. Since the tool is not properly supported against the rock, a reflection wave h propagating towards the percussion device is reflected from the primary stress wave p, the reflected wave having a large reflected tensile stress wave h+ but only a small reflected compression stress wave h− because, in soft rock, a small penetration resistance is not generated until at the end of the penetration of the tool. The largest part of the reflection wave thus mainly consists of tensile stress. When such a reflected stress wave h is detected, the control unit may recognize that drilling has been performed on a soft rock type. In that case, the control action may be: reduce the amplitude of the ingoing stress wave p, which allows decreasing the reflected tensile stress wave h+ detrimental to the drilling equipment. Alternatively, a tool having a greater penetration resistance may be employed.

Figure 15:
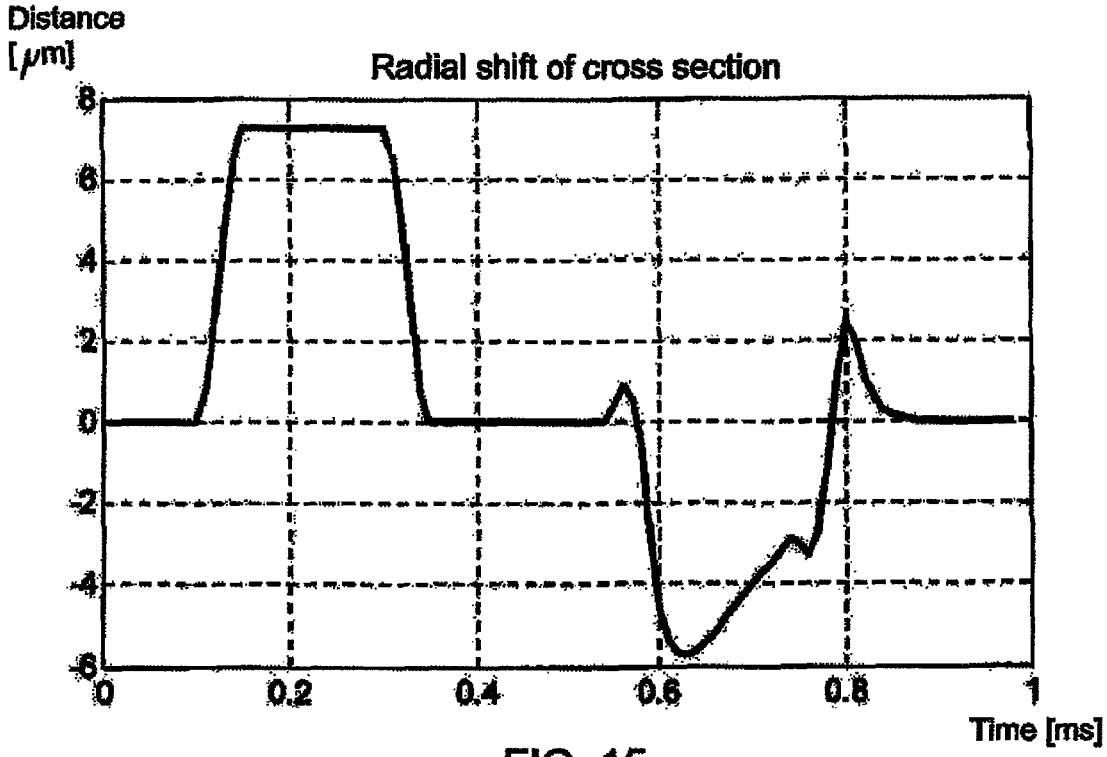
Figure 16:
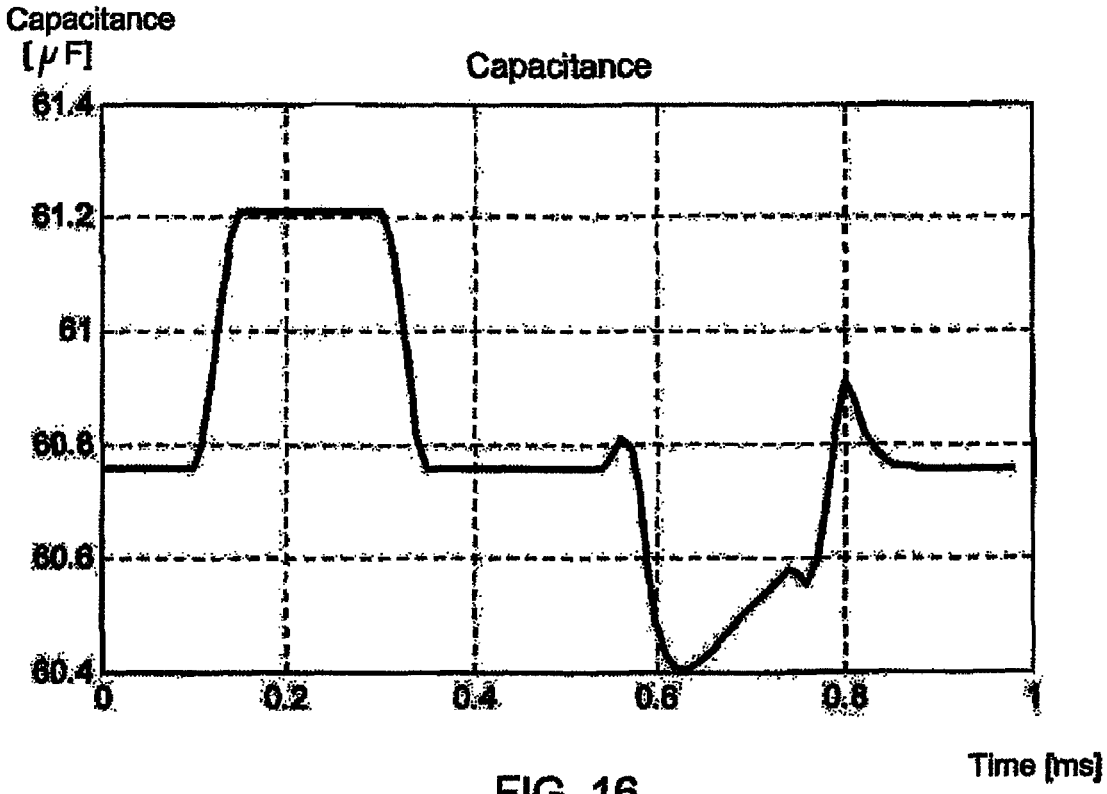

As appears from FIGS. 14 to 16, the change in the capacitance and the radial shift in the waveguide substantially correspond to the form of the stress wave.

EXAMPLE 3

Figure 17:
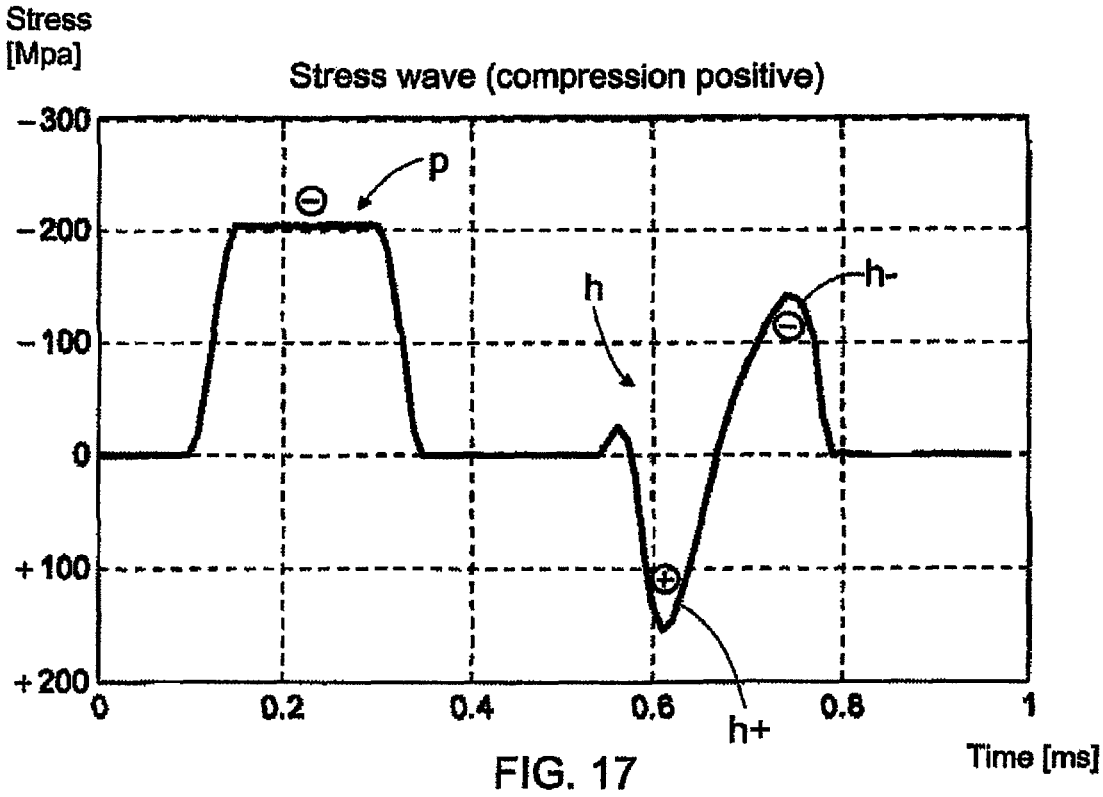

FIG. 17 illustrates curves of a primary stress wave p and reflected stress wave h as a function of time.

Figure 18:
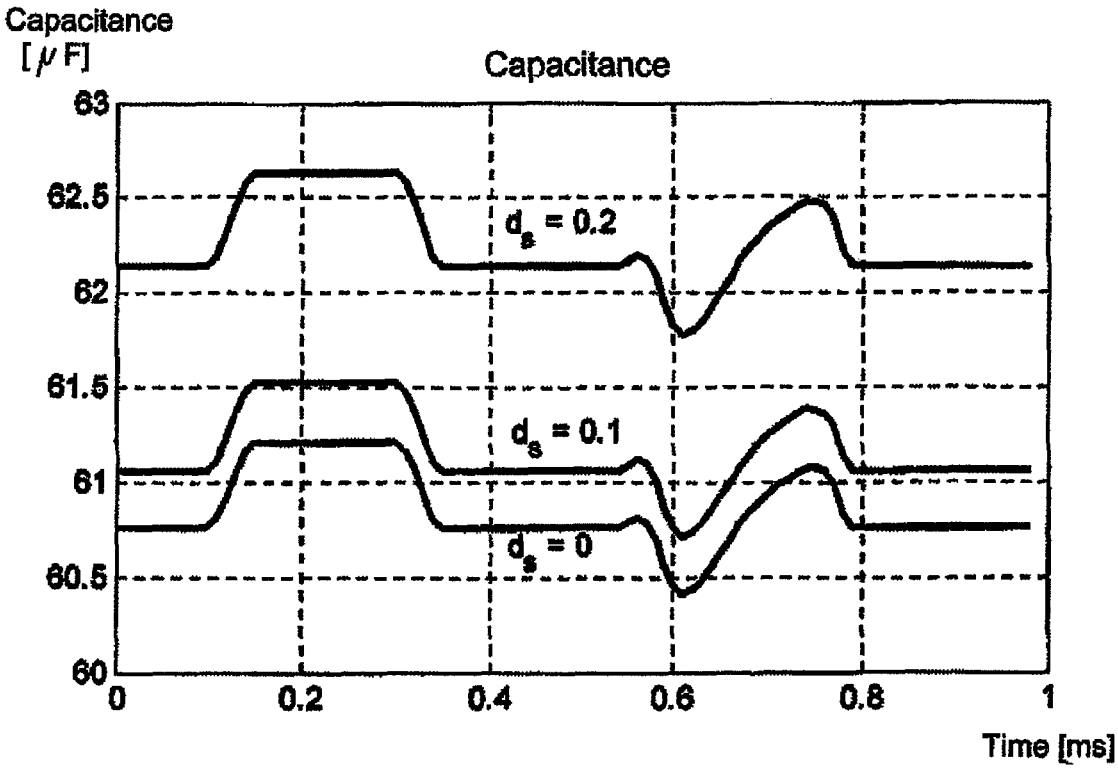

An annular measuring electrode may be arranged around the waveguide to be measured, i.e. typically around the drill rod in rock drilling machining. If the drill rod is eccentric with respect to the measuring electrode, eccentricity causes a change in the capacitance. FIG. 18 illustrates capacitance for three different eccentricity values.

A relative eccentricity $d_s$ may be calculated by the following formula:

$$d_s = \frac{d}{R - r_0}$$

However, it should be noted that, for the measuring method of eccentricity to be useful, the capacitance change caused by eccentricity and the change in the cross section caused by the drill rod should be distinguished from each other.

Figure 19:
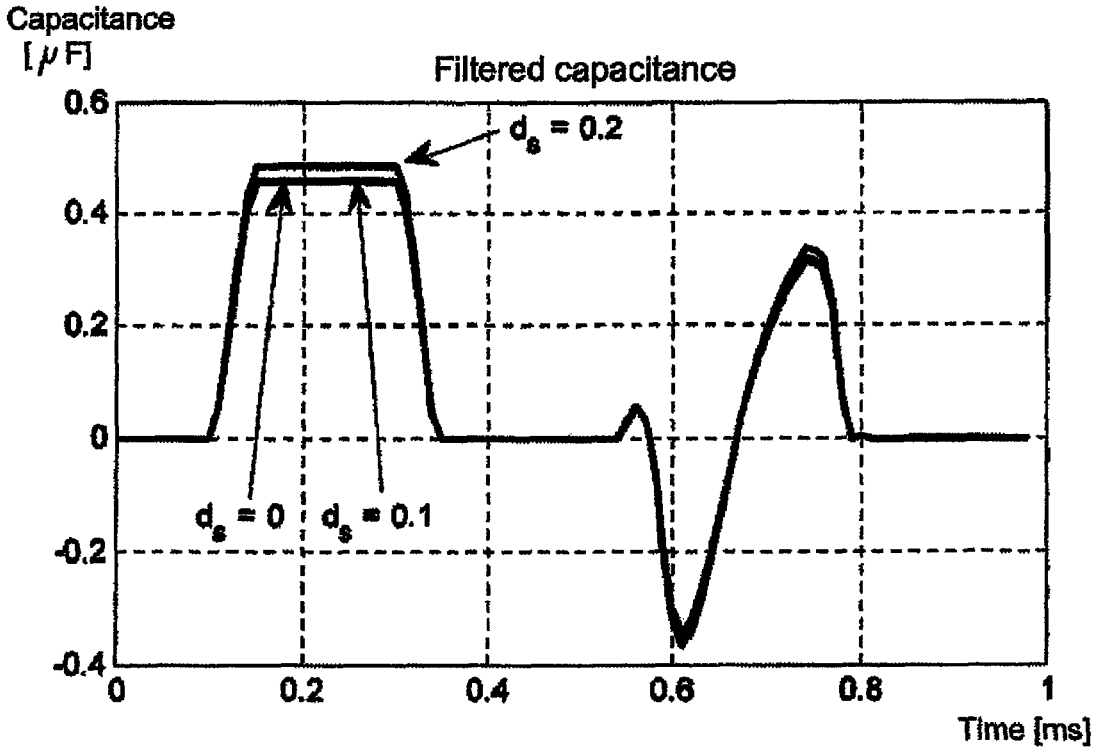

When eccentricity is small, the eccentricity error may be eliminated by, for example, filtering low-frequency components from the signal. This yields the signals according to FIG. 19.

The eccentricity error can be compensated for even better by using relative capacitance $C_s$ according to the following formula:

$$C_s = \frac{C}{C_0}$$

where $C_0$ is the capacitance between an eccentric but non-deformed drill rod and an electrode. This is achieved by measuring capacitance in a situation where no stress wave acts at the measuring point.

Figure 20:
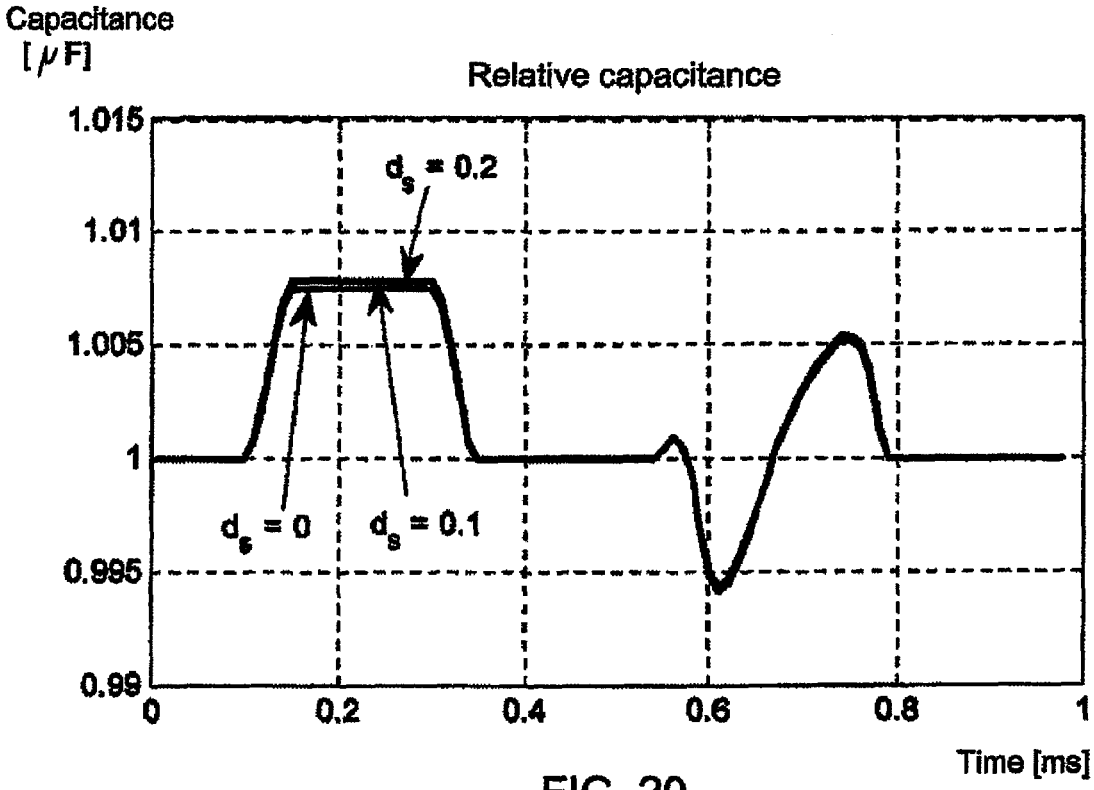

This yields the signals according to FIG. 20.

It should still be noted that the invention may be applied both in connection with a pressure medium operated and an electrically operated percussion device 7. The type of the device by which stress waves are generated in the waveguide 21 is not relevant to the implementation of the invention. Thus a stress wave may be generated by a suitable wave generator without a proper impact and percussion piston, for example directly from hydraulic pressure energy. In other words, a short force effect is generated in the waveguide by a percussion device or a similar device that generates stress waves, and the force effect generates a stress wave in the waveguide. The stress wave generated by the device may be a compression stress wave or a tensile stress wave.

The effect of the stress wave on the geometric cross section of the waveguide can be detected by a measuring device. Both the stress wave given to the waveguide and the reflected stress wave cause a geometric change in the cross section of the waveguide. The form and other properties of the stress waves may be analysed on the basis of the measurement results in the control unit of the measuring device, in the control unit of the rock breaking device or in another control or computing unit. It may also be determined whether the stress wave is an ingoing stress wave or a reflected stress wave as well as their different wave components.

It is also feasible to arrange a measuring device 23 according to the described embodiments in connection with the percussion device and determine the impact force, impact frequency, etc., on the basis of changes in the cross section of a percussion element, such as a percussion piston. In this case, the percussion element functions as the waveguide.

In addition to drilling, the measurement of stress waves according to the invention may be applied in other devices employing impact pulses, such as breaking hammers and other breaking devices intended for breaking rock material or another hard material, and further in piling equipment, for instance.

In some cases, the features presented in this application may be employed as such regardless of the other features. On the other hand, the features illustrated in this application may, if necessary, be combined to obtain various combinations.

The drawings and the related description are only intended to illustrate the inventive concept. The details of the invention may vary within the scope of the claims.

The invention claimed is:

1. A method of measuring a stress wave used in rock breaking, the method comprising:

measuring a stress wave which propagates in a waveguide;

determining a geometric change in the cross section of the waveguide as the stress wave passes a measuring point;

determining the geometric change in the cross section of the waveguide without a mechanical contact between the measuring member and the waveguide; and determining properties of the stress wave from the geometric change in the cross section of the waveguide.

2. A method according to claim 1, comprising determining distance between the waveguide and at least one measuring member.

3. A method of measuring a stress wave used in rock breaking, comprising measuring a stress wave which propagates in a waveguide;

determining a geometric change in the cross section of the waveguide as the stress wave passes a measuring point;

determining the geometric change in the cross section of the waveguide without a mechanical contact between the measuring member and the waveguide;

determining properties of the stress wave from the change in the cross section; and determining capacitance between the waveguide and at least one measuring electrode.

4. A measuring device for measuring a stress wave, the device comprising:

at least one contact-free measuring member for detecting without a mechanical contact a geometric change in the cross section of a waveguide due to the influence of the stress wave; and at least one control unit for processing measurement results, wherein the control unit is arranged to determine properties of the measured stress wave from the geometric change in the cross section of the waveguide.

5. A measuring device for measuring a stress wave, comprising:

at least one contact-free measuring member for detecting without a mechanical contact a change in the cross section of a waveguide due to the influence of the stress wave; and at least one control unit for processing measurement results, wherein the control unit is arranged to determine properties of the measured stress wave from the change in the cross section of the waveguide; and wherein the measuring device comprises means for determining capacitance between the waveguide and at least one measuring electrode.

6. A measuring device according to claim 4, wherein the measuring device comprises means for determining capacitance between the waveguide and at least one measuring electrode, and the measuring electrode is an annular electrically conductive piece which is arrangeable around the waveguide.

7. A measuring device according to claim 5, wherein the measuring device comprises means for determining capacitance between the waveguide and at least one measuring electrode, the measuring device comprises two measuring electrodes which are arranged axially one after the other, an insulation layer is arranged between the measuring electrodes, and wherein the control unit is arranged to measure capacitance between the successive measuring electrodes and the waveguide.

8. A measuring device according to claim 4, wherein the measuring device comprises at least one memory element for storing measurement results.

9. A measuring device according to claim 4, wherein the measuring device comprises at least one data transfer member for transmitting measurement results from the measuring device to another device.

10. A rock breaking device comprising:

a frame;

a tool;

a device for generating stress waves in the tool;

measuring means for measuring the stress wave travelling in the tool;

at least one control unit for controlling the rock breaking device on the basis of the measured stress wave, contact-free means for detecting without a mechanical contact a geometric change in the cross section of the tool due to the influence of the stress wave, and wherein at least one control unit is arranged to determine properties of the stress wave on the basis of the change in the cross section of the tool for controlling the rock breaking device.

11. A rock breaking device according to claim 10, wherein the rock breaking device is a rock drilling machine, which comprises a shank where stress waves are generated by a percussion device and to which the tool is attached;

the measuring means comprise at least one annular electrically conductive measuring electrode which is arranged around the shank;

the measuring electrode is arranged to measure capacitance between the outer diameter of the shank and the measuring electrode, the capacitance being directly proportional to the distance between the outer diameter of the shank and the measuring electrode, wherein the control unit is arranged to determine properties of the stress wave from the change in capacitance.

* * * * *